United States Patent [19]

Zumwalt et al.

[11] Patent Number: 5,056,620

[45] Date of Patent: Oct. 15, 1991

[54] STEPLADDER PLATFORM

[76] Inventors: Donald A. Zumwalt; Jean M. Zumwalt, both of 1946 Glenoaks Blvd., San Fernando, Calif. 91340

[21] Appl. No.: 599,059

[22] Filed: Oct. 17, 1990

Related U.S. Application Data

[63] Continuation of Ser. No. 512,870, Apr. 23, 1990.

[51] Int. Cl.[5] ..... E06C 7/16

[52] U.S. Cl. ..... 182/120; 248/238

[58] Field of Search ..... 182/120, 121, 122; 248/238

[56] References Cited

U.S. PATENT DOCUMENTS

| | | | |
|---|---|---|---|
| 1,658,753 | 2/1928 | Wirth | 182/120 |
| 2,066,108 | 12/1936 | Hedges | 182/120 |
| 2,444,096 | 6/1948 | Faust | 182/120 |
| 2,730,412 | 1/1956 | Yoder | 182/120 |
| 3,078,950 | 2/1963 | Schramm | 182/120 |
| 3,112,811 | 12/1963 | Moran | 182/120 |
| 3,294,197 | 12/1966 | Kwiatkowski | 182/120 |
| 4,300,740 | 11/1981 | Killian | 182/120 |
| 4,437,544 | 3/1984 | Anderson | 182/120 |

*Primary Examiner*—Reinaldo P. Machado

[57] ABSTRACT

A stepladder platform which can be installed onto the steps of a stepladder to provide an enlarged standing area. A restraining means at the rear engages the stepladder step to prevent forward movement and tilting. A restraining means at the front prevents rearward movement. Also a latch device can be used to prevent tilting from the front. The platform is constructed to support the weight of a person standing on it.

23 Claims, 2 Drawing Sheets

FIG. 1
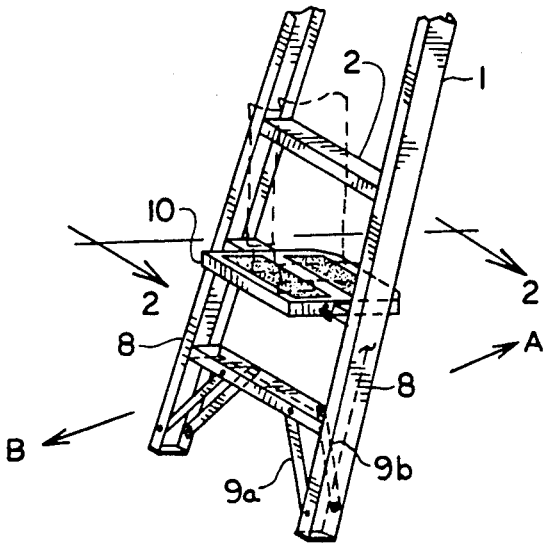
FIG. 2A
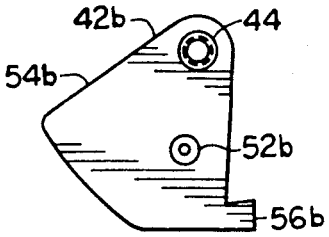
FIG. 2B
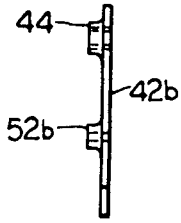
FIG. 2
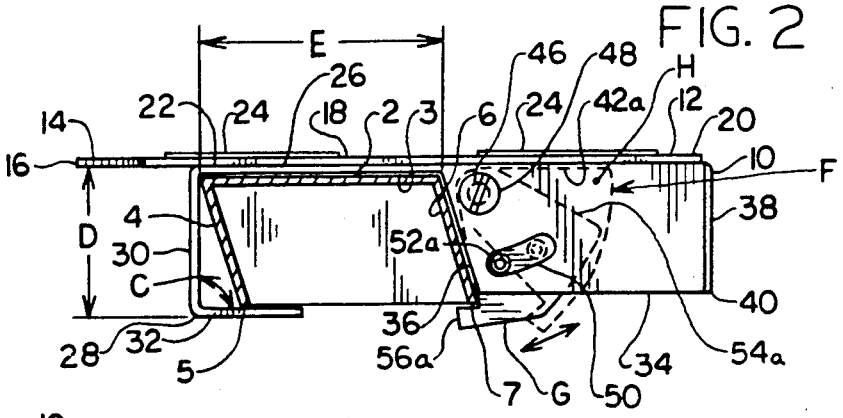
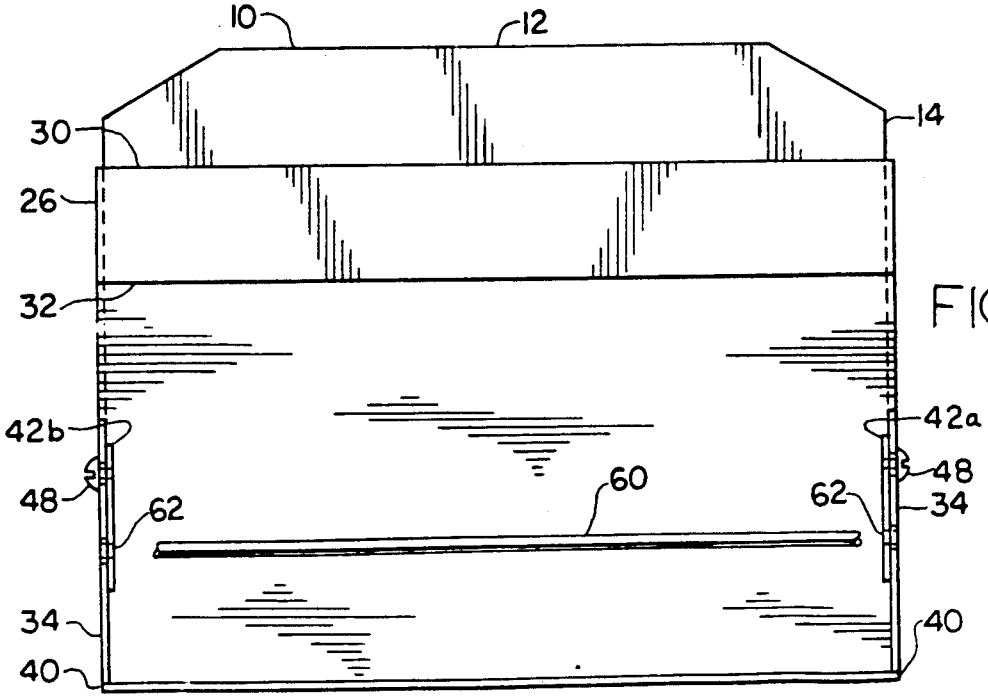
FIG. 3

FIG. 4
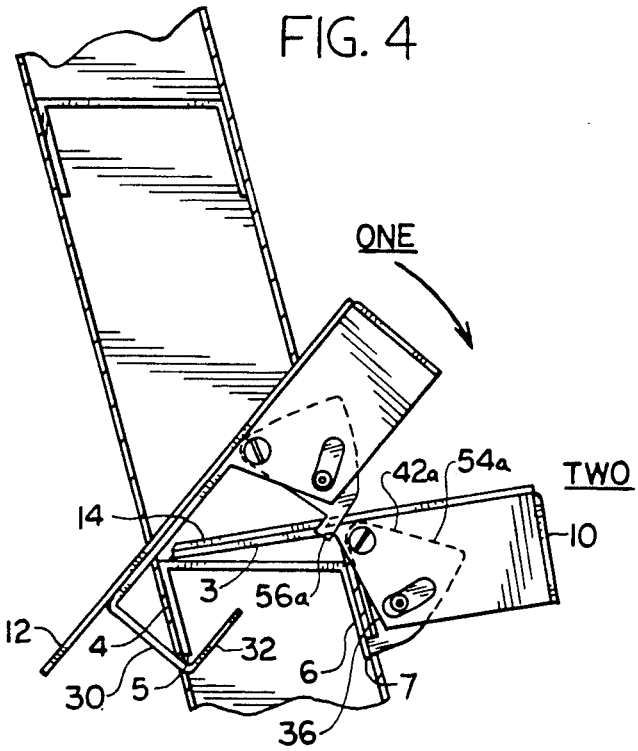
FIG. 7
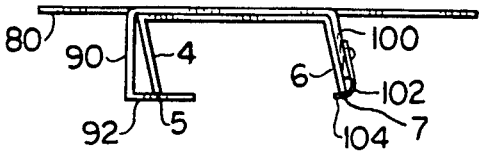
FIG. 6
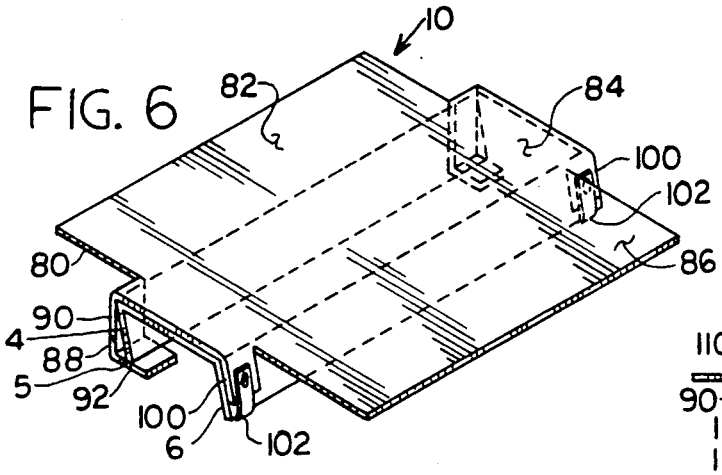
FIG. 8
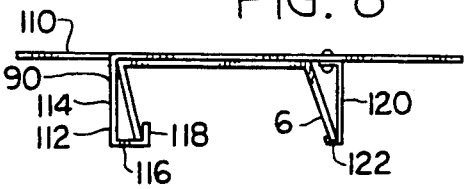
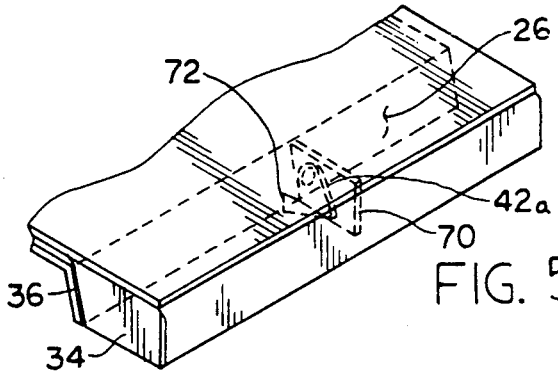
FIG. 5

STEPLADDER PLATFORM

This is a continuation-in-part of Ser. No. 512,876 filed on Apr. 23, 1990.

BACKGROUND OF THE INVENTION

This invention relates to stepladder platforms for use with a stepladder of the type in which the step is formed from a channel member.

DESCRIPTION OF THE PRIOR ART

Improvements in and accessories for use with ladders are known. U.S. Pat. No. 4,300,740, shows a paint shelf combined with brackets to engage the back edge and underside of a step and a pin slidable in a hole in the shelf which can drop down to be engaged against the front edge of the step to prevent rearward movement of the shelf. U.S. Pat. No. 3,294,197 shows a flat foot supporter perch for a rung type ladder. U.S. Pat. No. 3,112,811 shows an auxiliary safety step for rung type ladders. U.S. Pat. No. 3,078,950, discloses a platform step which when installed forms with the stepladder step, a wider step or platform.

SUMMARY OF THE INVENTION

The invention comprises a stepladder platform which provides an enlarged foot resting platform and engagement means which prevent lateral (that is, inward or outward) movement. Also, means are described to prevent tilting movement in one or both possible tilt directions. The invention is particularly adapted for use with channel type stepladders. In particular a platform rests on the stepladder step while a hookflange across the back of the step ladder platform engages the rear channel wall of the stepladder step to prevent forward movement and tilting of the platform. Other means at the front of the step platform prevent rearward movement. In another preferred mode, a displaceable catch at the front of the stepladder platform engages under the forward channel wall to prevent tilting.

BRIEF DESCRIPTION OF THE DRAWINGS

FIG. 1 shows a partial perspective view of the stepladder platform installed on a stepladder.

FIG. 2 shows a section view from 2–2 of FIG. 1 with the stepladder platform in place, and showing the range of movement of the front latch.

FIGS. 2A and 2B show a side and front view respectively of the latch.

FIG. 3 shows a bottom view of the stepladder platform.

FIG. 4 shows a partial side view illustrating the procedure for installing the stepladder platform on a step ladder and the action of the parts during installation.

FIG. 5 shows an alternative mode of construction.

FIG. 6 shows an alternative mode of construction.

FIG. 7 shows a side view of the construction of FIG. 6.

FIG. 8 shows another alternative mode of construction.

DETAILED DESCRIPTION OF THE INVENTION

In the following description, a number of directional descriptions are used. These are "inward" or "rearward" meaning the direction shown by arrow A, "outward" or "forward" meaning the direction shown by arrow B, these being "lateral" directions. "Right" and "left" are taken as seen approaching the ladder in FIG. 1. Similarly "rear" or "inner" is associated with a position away from the user standing before the ladder while "front" or "outer" is a position near or toward a user. "Width" is a right-left dimension. "Clockwise" and "counterclockwise" are taken as seen in FIGS. 2 and 4.

Referring to FIGS. 1 through 3, the typical stepladder 1 has steps 2 which are formed of channel sections having an upper channel wall 3, a rear channel wall 4 having a lower terminal edge 5, and a front channel wall 6 having a lower terminal edge 7. The steps are attached to stiles 8. Also there are diagonal braces **9*a* and 9*b* between the lower step and the stiles 8**. A typical stepladder is exemplified by a five step ladder made by Keller Model No. 776. In most stepladders, braces are fitted on the lowest step; but on some especially on very high stepladders, there may be diagonal braces on several steps. Also, as is well known, the width of the steps varies from wider on the lowest step to narrower on the upper steps.

The stepladder platform 10 of this embodiment is made from two separate pieces of 16 gauge sheet metal. The first piece, being the platform 12, is a flat sheet of 16 gauge steel, about $7\frac{3}{4}$ inches in lateral dimension and $12\frac{3}{4}$ inches in width. For convenience, it is useful to designate three portions for the step platform. The inner portion 14 extends from the inner end 16 to approximately the line defined by the corner of the rear channel wall 4 and the upper channel wall 3. The central portion 18 is that area which is directly above and supported by the upper channel wall 3. The outer portion 20 is that portion which extends outwardly of the central portion 18 to the outer end 22. Means are provided on top of the step platform to provide a good frictional surface. In this case, rough friction-grip-tape strips 24 are used. Alternatively, the upper surface could be roughened, distorted or coated with a particulate containing film.

The second piece of the stepladder platform is also formed from a flat sheet of 16 gauge sheet metal. In this case, it is cut and formed to provide several elements of the stepladder platform. The base 26 is flat and joined to the platform 12 such as by spot welding or riveting. The base 26 is 6 inches in lateral dimension and $12\frac{3}{4}$ inches in width dimension so that it extends slightly beyond the platform 12 at the front in order to avoid presenting sharp edges of the platform 12 to a user. At the inner end of the base 26, the hookflange 28 is bent downward and extends across the full width of the base 26. The hookflange 28 has a flange portion 30 extending downwardly and a hook portion 32 extending forwardly about $1\frac{1}{4}$ inches, both extending across the full width of the base 26. The angle C should be 90° or slightly less. The drop dimension D of the flange portion 30 is enough to allow the hook portion 32 to fit under the lower terminal edge 5 sufficiently close to minimize allowable movement when installed. About $1\frac{3}{4}$ inches will work for most stepladders. With the above dimensions, the stepladder platform 10 will fit on all legally usable steps of the example Keller Model No. 776 stepladder, except for the lowest step above the braces **9*b***.

Bent down at each of the right and left sides of the base 26 are side flanges 34. The side flanges 34 have a rearward facing edge 36 which is cut at an angle such that when installed it approximately parallels the front channel wall 6. There is also a box flange 38 bent down at the front end of the base 26 and with the side flanges 34 closely defining the corner 40. The dimension E being the space between the flange portion 30 and the edge 36 at its uppermost point is about 3 inches or slightly larger by way of the tolerances in order to closely receive the step 2 of most stepladders of this type in current use.

This structure will provide a strong platform when installed on a step channel, resisting distortion from the weight of a user; while providing a comfortable platform on which the user can place his full foot, sole and heel, and have the ability to stand normally in different positions. In particular, the flange portion 30 restrains the device against forward movement, while the edges 36 restrain it against rearward movement. The hook portion 32 prevents clockwise tilting. As can be seen, much of the weight of the user will be placed outward of on the outer portion 20 beyond the step 2, so there is a tendency for counterclockwise rotation. Also, the weight of the user on the outer portion 20 will tend to bend it downward, but this will cause the edges 36 to press against the front channel wall 6 preventing bending. The edges 36 do not have to exactly fit parallel to the outer channel wall 6, as a slight bending will bring them into contact. That contact will create a very strong rigid structure. The box flange 38 provides added rigidity. Thus, the whole structure is firm and rigid, and when installed will not slide in or out, and will resist distortion from forces applied, and will not tilt clockwise.

Of course, all of these dimensions could be varied to suit a desired configuration; however, it is important that certain dimensional limitations be observed in order to ensure fitting the greatest number of stepladder steps. In this respect, it is known that the most common dimensions of the step channel are 3 inches at the top, 1 19/32 inches at the front channel wall and 1 19/32 inches at the rear channel wall. In a typical five step ladder, the upper step is 12⅛ inches wide and the lower step is 18 inches wide. However, most ladders have a pair of braces **9*b* extending at an angle from the rear channel wall 4 to the stiles 8, at least on the lowest step. This pair of braces reduces the effective usable width of the step 2 for purposes of the present invention in the case of the Keller ladder mentioned above to 11 ¼ inches. Also, there may be a pair of braces 9*a* extending at an angle from the front channel wall 6 to the stiles 8, but these will not interfere with use of the invention. Therefore, in this embodiment the entire step platform 10 must fit between the rear braces 9*b*** when used on a braced step.

Alternatively, portions of the hookflange 28 could be cut out leaving a vacant space to receive the braces **9*b*** in the space thereby created; in which case, the cut-outs or vacant space should be of such dimension to accommodate the widest practical range of brace placements on stepladder steps without degrading the function of the hookflange. With this cut-out, the stepladder platform would fit on the lowest step of the example Keller stepladder.

In another embodiment of the invention latches **42*a* and 42*b* are pivotably attached to the side flanges 34 by means of a fastener assembly. As seen in FIGS. 2, 2A, 2B, 3 and 4, the latches 42*a* and 42*b* are cut and formed from sheet metal. In this case the fastener assembly is an extruded threaded pivot nut 44 which is part of the latches 42*a* and 42*b* and extends through a hole 46 in the side flanges 34, the extrusion being just a little longer than the thickness of the side flanges 34 in order to provide free pivoting when attached. Threaded into the extruded threaded pivot nut 44 is a screw 48 completing the fastener assembly. Thus, the latches 42*a* and 42*b* are freely pivotable on the side flanges 34. The range of pivotal movement of the latches 42*a* and 42*b* is controlled by a slot 50 in the side flange 34 and stop pins 52*a* and 52*b* which are extruded in the latch and riding in the slots 50. The latches 42*a* and 42*b* also have lobes 54*a* and 54*b*; the weight of which causes the latches to rotate into the latched position, as will be explained later. Opposite the lobes 54*a* and 54*b* are catches 56*a* and 56*b*. As seen in FIG. 2 the latches 42*a* and 42*b* are pivotable between positions F and G. In position G, the corner of the latch 56*a* and 56*b* will strike the outer channel wall 6 before its pivoting is arrested by the slot 50, with the catches 56*a* and 56*b* now below the terminal edge 7**.

The installation procedure is shown in FIG. 4. This procedure is applicable to all embodiments, but is explained with reference to the above described embodiment. The stepladder platform 10 may be installed with one hand; thereby permitting the other hand to be available to hold onto the ladder for support.

To install the stepladder platform 10, it is placed in the up-tilted position shown in position One FIG. 4, the hook 32 being placed to catch on the lower terminal edge 5 of the rear channel wall 4. Then the stepladder platform is rotated clockwise into final position. As it reaches near the end of this movement, the catches **56*a* and 56*b* will touch against a lower portion of the front channel wall 6 as shown in position two in FIG. 4. Finally, when the base 14 of the step platform 10 is resting flat on the upper channel wall 3, the catches 56*a* and 56*b* will rotate into latched position beneath the lower terminal edge 7 of the front channel wall 6 as shown in FIG. 2. The lobes 54*a* and 54*b*** will provide sufficient weight to cause reliable proper pivoting of the latches into position.

The latches **42*a* and 42*b*** are automatically biased by weight into latched position. The latches could be more positively forced into position by being spring-loaded. Also, other types of latches could be employed, such as those later described herein. Latches which do not have automatic biasing could also be employed such as slide bolts and any latch could be used with a positive lock means.

Now fully installed the step platform is restrained against forward lateral movement by contact of the flange portion 30 against the rear channel wall 4. It is restrained against rearward lateral movement by contact of the restraining edge 36 against the front channel wall 6. Tilting clockwise as seen in FIGS. 2 and 4 is restrained by the hook 32 against the lower terminal edge 5. Tilting counter-clockwise is restrained by the catches **56*a* and 56*b* against the lower terminal edge 7**.

When used, a person may stand on the platform, with the entire foot sole and heel supported as in normal standing posture. Reaching can be done standing on tip-toe. A person can shift feet at an angle to the base partly left or right. Thus the stepladder platform provides an enlarged comfortable and safe platform for use with a stepladder of the channel step type.

To remove the step platform, the latches **42*a* and 42*b*** are rotated by hand away from the step channel to free the step platform for counter-clockwise tilting, opposite the motion for installation.

A number of further alternative embodiments are possible which may be employed within the general scope of the invention.

A dimple may be struck into each of the sides flanges 34 as shown at the point designated H. Therefore, when removing the step platform 10, the latches 42*a* and 42*b* can be rotated into interference with the dimples H, so that by frictional engagement they will stay in place. This will allow removal with one hand, by first disengaging one latch, and then the other, the latches remaining disengaged. However, this presents a safety issue as it may defeat the fault-free automatic engagement of the latches upon installation when they are freely pivotable.

Another alternative is to place a rod 60 (partially shown between the latches 42*a* and 42*b*, for example, by friction fit in the holes 62 in the stop pins 52*a* and 52*b*. The latches 42*a* and 42*b* then can be simultaneously released by pulling on the rod 60 near its center and the entire device removed, all with one hand.

A still further embodiment is shown in FIG. 5. In this embodiment, the side flanges 34 are not equipped with latches. Rather, a third central flange 70 parallel to the side flanges 34 is cut and bent from the base 26 centrally of the width of the base. A latch 72 is pivotable mounted on the central flange 70 as described above. The latch 72, its mounting and pivoting action is as described with respect to the latches 42*a* and 42*b* on the side flange 36. Therefore, the stepping platform can be removed with one hand by disengaging the latch 72.

A still further embodiment is shown in FIGS. 6 and 7. In this embodiment, the stepladder platform 10 is made from a single sheet metal base 80 having a rear portion 82, a central portion 84 and front portion 86. Rear hook flanges 88 are struck and bent downward from the base 80, with a flange 90 and a hook 92, to co-act with the rear channel wall 4 and lower terminal edge 5 as previously described. Front flanges 100 are struck and bent downward to co-act with the front channel wall 6. A spring latch 102 is attached to each of the front flanges 100. The spring latches 102 have a lower terminal hook portion 104 which will engage the lower terminal edge 7 when installed. To remove the stepping platform, the spring latches 102 are disengaged and the device tilted and removed as previously described.

FIG. 8 shows another alternative embodiment. This embodiment employs a single sheet metal base 110. Double hookflanges 112 are cut and bent at the right and left ends, similar to the hookflanges 88 in FIG. 6. The hookflanges 112, have a flange 114, a first hook 116 and a second hook 118. Spring metal clips 120 are attached to the base 90 and extend to the terminal edge 6, and have a hook portion 122 which engages the terminal edge 6. Therefore, the lateral restraint forward and rearward is effected by the flange 114 and second hook 112. Clockwise tilt is restrained by the hook 116 and counterclockwise tilt by the spring clip 120.

Any of the embodiments herein described could be formed of various other materials including plastic and fiberglass.

We claim:

1. A stepladder platform constructed of rigid material for attachment to a stepladder of the type having a step formed of a channel cross-section member supported at left and right ends by stiles the step channel having a top channel wall, a rear channel wall and a front channel wall and which is open at the bottom comprising, a stepping platform adapted to be placed upon and supported by the top channel wall of the step channel, the stepping platform extending laterally forward and rearward of the forward and rearward edges of the top channel wall to provide a platform of sufficient lateral dimension and area for the sole and heel of the feet of a person standing thereon;

at least one hookflange attached to the stepping platform and capable of co-acting with the rear channel wall to prevent forward lateral movement and tilting of the stepping platform.

2. The stepladder platform of claim 1, further comprising at least one front lateral restraining element attached to the stepping platform and capable of co-acting with the front wall of the step channel to restrain rearward lateral movement of the stepping surface.

3. The stepladder platform of claim 2 in which the hookflange comprises a flange portion extending downwardly from the stepping platform substantially the full width of the stepping platform, and at least one hook portion extending in forwardly of the flange portion.

4. The stepladder platform of claim 3 wherein the hook portion is co-extensive in width to the flange portion.

5. The stepladder platform of claim 4 in which the hook portion of the hookflange has a vacant area centrally of the width thereof such that separate hooks remain defining the left and right terminus of the vacated area.

6. The stepladder platform of claim 2 wherein the front lateral restraining element is at least a pair of flanges each extending respectively from proximate the left and right ends of the stepping platform.

7. The stepladder platform of claim 2 wherein said flanges extend front-to-rear and downwardly from the stepping platform and have a rear edge proximate to the front channel wall.

8. The stepladder platform of claim 2 further comprising a latch adapted to engage in a latched position the lower edge of the front channel wall to prevent counterclockwise tilting of the stepladder platform and having an unlatched position.

9. The stepladder platform of claim 8 in which the latch is biased to the latched position when the stepladder platform is in operating position on a stepladder.

10. The stepladder platform of claim 1 further comprising means co-acting between the portion of the stepping platform which is extending laterally forward of the top channel wall and the forward channel wall for bracing the said portion of the stepping platform against bending.

11. A stepladder platform constructed of rigid material for attachment to a stepladder of the type having a step formed of a channel cross-section member supported at left and right ends by attachment to stiles, the step channel having a top channel wall, a rear channel wall and front channel wall and which is open at the bottom comprising;

a stepping platform of generally rectangular shape adapted to be placed upon and supported at a central position by and laterally co-extensive with the top channel wall and having an inward portion extending inwardly beyond the central portion and having an outward portion extending outwardly beyond the central portion to provide a platform of sufficient dimension for both feet of a user;

a hookflange attached to the stepping platform comprising a flange portion attached to and extending downwardly from the step platform substantially the entire width thereof and attached thereto at approximately the inner terminus of the central portion of the stepping platform, and a hook portion extending substantially the entire width dimension of the flange portion forwardly from its lower terminal end;

a pair of front flanges each being attached to and extending along the inward-outward direction of the step platform being located respectively at the right and left end of the step platform and presenting an inner edge substantially parallel to the front channel wall.

12. The stepladder platform of claim 11 in which the hook portion of the hookflange has a vacant area centrally of the width of the flange portion such that separate hooks remain defining the left and right terminus of the vacant area.

13. The stepladder platform of claim 11 further comprising a latch pivotably attached to each of the front flanges each latch having a catch, and being pivotable between a latched position in which the catch is below a terminal edge of the front channel wall and a range of unlatched position in which the catch is pivoted out of the latched position.

14. The stepladder platform of claim 13 further comprising a box flange attached to and extending downwardly along the width of the front portion of the step platform, terminating at the left and right edges proximate the outer edge of each of the front flanges respectively.

15. The stepladder platform of claim 13 wherein the step platform is a first piece of material and the hookflange, front flanges and box flanges are formed of a single second piece, which also has a top portion and is attached to the first piece at the top portion.

16. The stepladder platform of claim 15 wherein the first and second pieces are sheet metal, and the top, hookflange, front flange and box flange of the second piece are formed by cutting and bending a single piece of sheet metal.

17. A stepladder platform for attachment to a stepladder of the type having a step formed of a channel cross-section member supported at left and right ends by stiles with the step channel having a top channel wall, a rear channel wall and a front channel wall an which is open at the bottom comprising a stepping platform adapted to be placed upon and supported by the top channel wall, the stepping platform extending laterally forward and rearward of the forward and rearward edges of the top channel wall to provide a platform of sufficient lateral dimension and area for the sole and heel of the feet of a person standing thereon, means rearward of the platform for engaging the rear channel wall to prevent forward movement of the platform and clockwise tilting of the platform means forward of the step channel for engaging the front channel wall to prevent rearward movement of the platform and counterclockwise tilting of the platform means for engaging the front channel wall to prevent counterclockwise tilting of the platform.

18. The stepladder platform of claim 17 wherein said means for preventing counterclockwise tilting comprises at least one means moveable between a latched position in which the said means engages the front channel wall, and an unlatched position.

19. The stepladder platform of claim 18 where said means for preventing counterclockwise tilting when in the unlatched position is biased toward the latched position when the platform is in operating position.

20. The stepladder platform of claim 18 wherein said means for preventing counterclockwise tilting is a latch pivotable between said latched and unlatched positions.

21. The stepladder platform of claim 20 wherein said latch has an upper pivot and a rearward catch for engaging beneath the lower edge of the forward channel wall and said biasing is provided by a lobe forward of the pivot.

22. The stepladder platform of claim 19 wherein said biasing is provided by the said means being spring biased.

23. The stepladder platform of claim 17 further comprising means for co-acting between the portion of the stepping platform formed of the top channel wall and the front channel wall to brace said portion against bending when a weight is placed upon said portion.

* * * * *